United States Patent [19]

Peterson et al.

[11] 4,161,850

[45] Jul. 24, 1979

[54] ROOM DIVIDER

[76] Inventors: Lyle R. Peterson, 429 E. 1700S, Bountiful, Utah 84010; Brent A. Peterson, Rte. #3, Rexburg, Id. 83440

[21] Appl. No.: 874,313

[22] Filed: Feb. 1, 1978

[51] Int. Cl.[2] ..... E04B 2/82

[52] U.S. Cl. ..... 52/65; 52/70; 52/71; 52/239; 16/135; 160/351

[58] Field of Search ..... 52/239, 70, 71, 143, 52/65; 160/135, 351, 210, 114; 16/129–135, 15

[56] References Cited

U.S. PATENT DOCUMENTS

| | | | |
|---|---|---|---|
| 328,342 | 10/1885 | Robinson | 160/135 |
| 2,661,495 | 12/1953 | Kalleberg | 16/151 |
| 2,698,677 | 1/1955 | Tadd | 16/129 |
| 2,901,036 | 8/1959 | Greig | 16/135 |
| 3,916,972 | 11/1975 | Breiner | 52/71 |
| 3,984,949 | 10/1976 | Wahlquist | 52/70 |
| 4,034,524 | 7/1977 | Fromme et al. | 52/143 |
| 4,060,294 | 11/1977 | Haworth et al. | 160/135 |

*Primary Examiner*—James L. Ridgill, Jr.

*Attorney, Agent, or Firm*—Clarence A. O'Brien; Harvey B. Jacobson

[57] ABSTRACT

A room divider including a plurality of partition panels hingedly interconnected with one end of the panel assembly being pivotally connected to a permanent wall or other vertical support. Each of the panels forming the room divider is provided with caster support means for engaging a floor surface and the end of the panel remote from connection with the permanent wall or support is provided with an access door pivotally connected to the panel. The panels are pivotally or hingedly connected by a unique hinge and attachment assembly, and the panel is attached to the permanent wall by a unique hinge and attachment assembly, and the access door is attached one of the panels by a unique hinge and attachment assembly, with each of the panels being constructed of a frame structure and a covering of carpeting material, or the like, for acoustical isolation, fire retarding capability and capability of receiving fastening devices for supporting chalk boards or other items to be displayed thereon, with the room divider being easy to install, easy to move and capable of many uses and installations.

9 Claims, 13 Drawing Figures

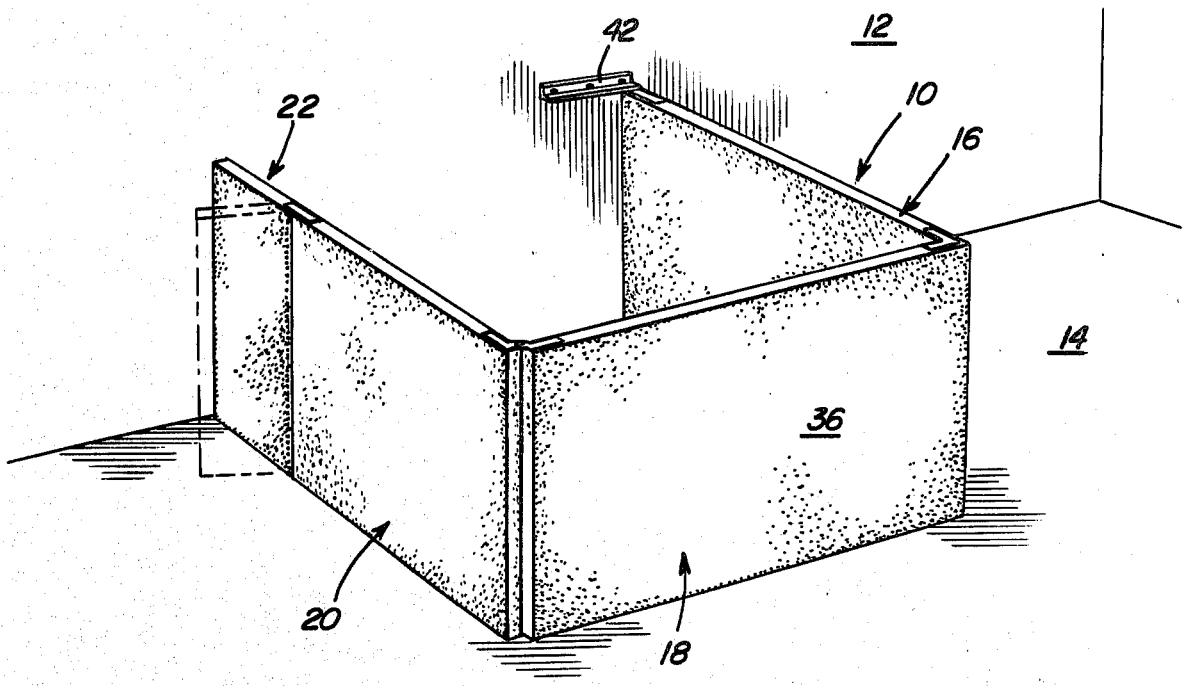
Fig. 2
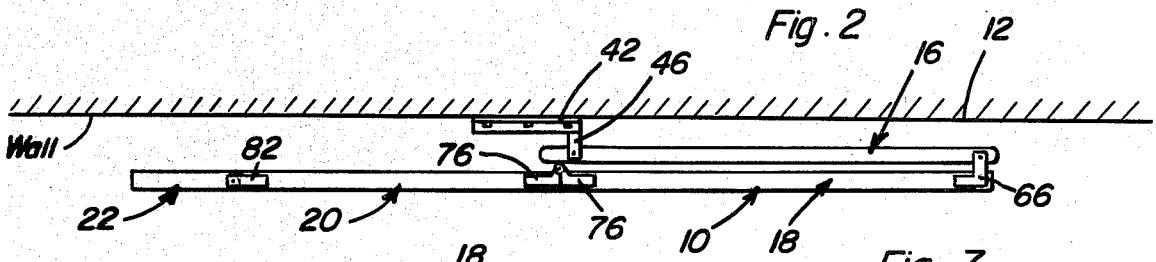
Fig. 3
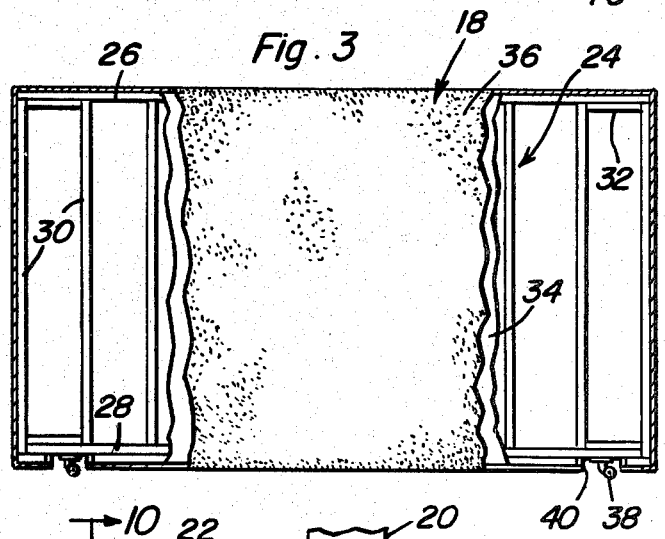
Fig. 7
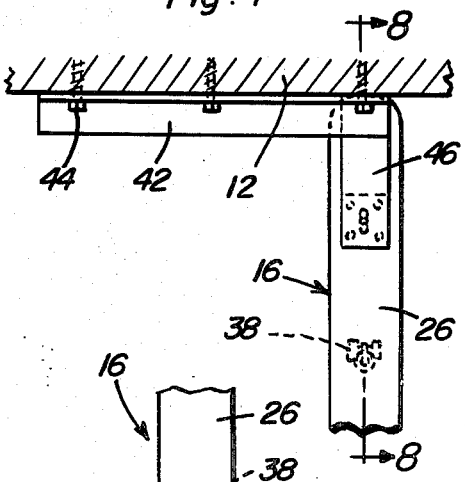
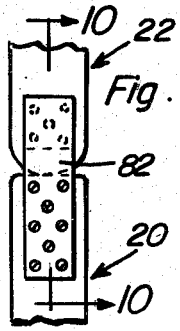
Fig. 4
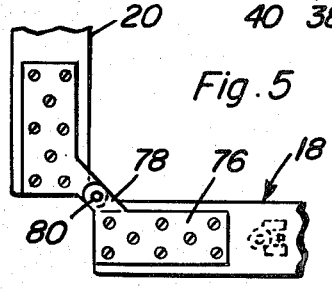
Fig. 5
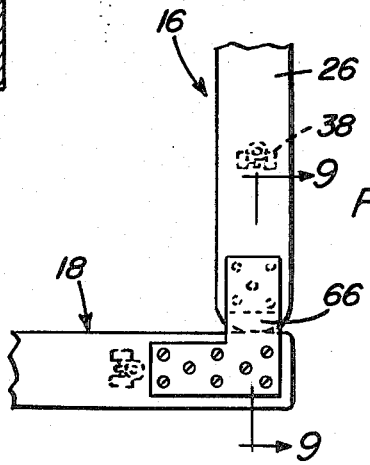
Fig. 6

ROOM DIVIDER

BACKGROUND OF THE INVENTION

1. Field of the Invention

The present invention generally relates to room dividers and more particularly a room divider including a plurality of hingedly connected modular panels with the end of an endmost panel being pivotally connected to the permanent wall or support by a unique hinge assembly and the panels in the panel assembly being hingedly connected with the endmost panel having an access door, with all of the panels being supported by supporting casters facilitating easy movement from a stored position alongside of the wall to a selected operative position for dividing a space into smaller enclosed spaces.

2. Description of the Prior Art

Large enclosed spaces, such as auditoriums, gymnasiums, cafeterias, and the like, found in schools, churches, motels, restaurants, office buildings, and the like, frequently are divided into smaller spaces by portable dividers or partitions or movable dividers and partitions which sometimes are supported from overhead trackways or between overhead trackways and floor trackways. Free standing partitions, while being quite versatile in use, are subject to being knocked over or displaced by accidental engagement therewith. Permanently installed folding walls or partitions, such as accordion folding partitions and dividers, and the like, are rather expensive and require considerable installation costs and lack flexibility of position. The following U.S. patents disclose room dividers related to the present invention.

U.S. Pat. Nos. 3,248,829—May 3, 1966
U.S. Pat. Nos. 3,463,218—Aug. 26, 1969
U.S. Pat. Nos. 3,538,976—Nov. 10, 1970
U.S. Pat. Nos. 3,565,152—Feb. 23, 1971
U.S. Pat. Nos. 3,690,365—Sep. 12, 1972
U.S. Pat. Nos. 3,766,959—Oct. 23, 1973.

SUMMARY OF THE INVENTION

An object of the present invention is to provide a room divider including a plurality of vertically disposed, hingedly interconnected panels supported from a floor surface by caster wheels or rollers with one of the panels having an end edge hingedly connected to a permanent wall or support and the free edge of the remote panel having an access door forming a portion of the modular length dimension of the panels.

Another object of the invention is to provide a room divider in which the hinged attachment between the permanent wall and end panel includes means enabling variation in the hinge axis to compensate for floor unevenness or irregularities.

A further object of the invention is to provide a room divider employing offset hinge structures connecting certain of the panels to enable the panels to pivot to various angular relationships to each other to enable flexibility of orientation of the panels.

Still another object of the invention is to provide a room divider in accordance with the preceding objects in which each of the panels is constructed with a vertical frame having a covering of fire retardant carpet thereon to acoustically isolate the enclosed space and provide a surface on which various articles may be easily supported for display and observation.

A still further object of the invention is to provide a room divider which is easily installed in existing structures and including a plurality of panels of modular dimensions, such as 4'×8', to enable the space enclosed or divided by the room divider to be varied with the room divider being associated with various other room dividers or provided with various numbers of panels to facilitate the division of a large enclosed space into smaller spaces for use of the large space as class rooms, conference rooms, and the like.

Still another important object of the present invention is to provide a room divider in accordance with the preceding objects which is not only easy to install but easy to operate and quite simple in construction and relatively inexpensive to install, operate and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the room divider of the present invention illustrating a typical installation and use thereof.

FIG. 2 is a plan view of the construction of FIG. 1 illustrating the room divider in folded, stored position alongside of the wall.

FIG. 3 is a side elevational view of one of the panels illustrating the frame construction thereof and the carpet covering thereon.

FIG. 4 is a plan view of the hinge connection between the access door and the adjacent panel structure.

FIG. 5 is a plan view of a hinge connection between adjacent panels.

FIG. 6 is a plan view of the hinge construction between other of the adjacent panels.

FIG. 7 is a plan view of the hinge connection between the permanent wall and adjacent panel.

DESCRIPTION OF THE PREFERRED EMBODIMENTS

Figure 8:
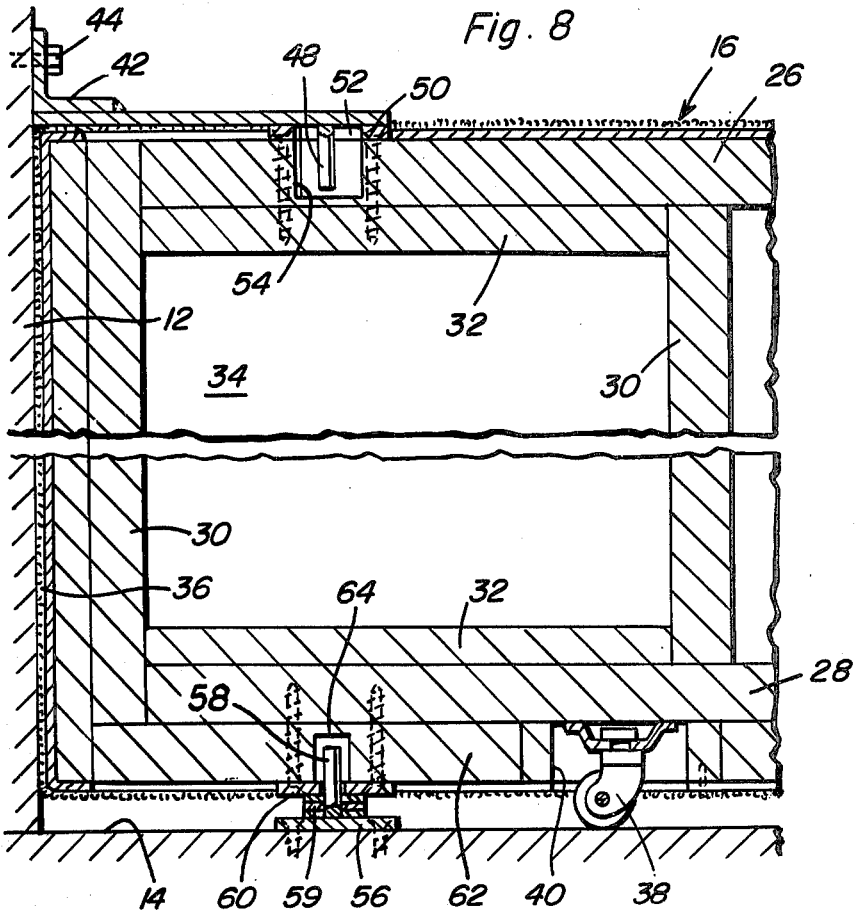
FIG. 8 is a longitudinal, sectional view, on an enlarged scale taken substantially upon a plane passing along section line 8—8 of FIG. 7 illustrating further structural details of this hinged connection.
Figure 11:
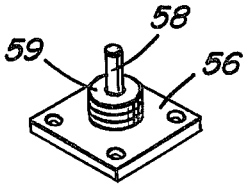
FIG. 11 is a perspective view of the hinge plate and hinge pin rigidly affixed thereto.
Figure 12:
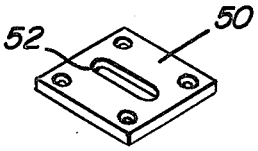
FIG. 12 is a perspective view of the slotted hinge plate.

Referring now specifically to the drawings, the room divider is generally designated by reference numeral 10 and in FIG. 1 is illustrated in operative position and in FIG. 2, it is illustrated in collapsed or stored position. The room divider 10 is mounted on and pivotally connected to a permanent wall 12 or other stationary vertical support and is disposed vertically on and supported from a floor 14 to enclose a space, such as a portion of a larger class room, auditorium, gymnasium, and the like. The embodiment of the room divider 10 illustrated in the drawings includes three panels 16, 18 and 20. The panel 16 has one end edge hingedly connected to the wall 12 and the other end edge hingedly connected to an end edge of the panel 18. The panel 20 has one end edge pivotally connected to the opposite end of the panel 18 and the opposite end of the panel 20 is provided with an access door 22 hingedly connected thereto and forming a portion of the modular length of the panel 20 so that all of the panels 16, 18 and 20 are of equal size. For example, each of the panels may have a length of 8 feet or more and a height of 4 feet or more although it is pointed out that the dimensional characteristics of the panels may vary depending upon the requirements of individual installations. Also, panel 18 may be omitted in many installations such as where a plurality of units are mounted along a wall.

FIG. 3 illustrates the details of one of the panels such as the panel 16 which includes an internal framework generally designated by numeral 24 which includes a top rail 26, a bottom rail 28 and a plurality of vertical studs 30 oriented in spaced relation and rigidly interconnecting the top and bottom rails 26 and 28 with the rails and studs being constructed of wood components of standard size, such as 2"×4" members. Reinforcing wood components 32 are provided at each corner of the frame to provide anchoring structures for long screws or other fastener devices. The large surfaces of the frame 24 are covered with a wood panel 34 of laminated wood, such as "plywood", or the like, and the entire panel including the inner and outer surfaces, top and bottom edges and end edges are covered with a carpet 36 having any desired decorative pattern, texture, or the like, and having fire resistant characteristics. Also, each end of the panel 18 is rollingly supported by a double roller caster assembly 38 partially recessed into the bottom edge of the panel as at 40, so that the weight of the panels is supported from the floor 14 by the double roller caster assemblies 38 with the lower edge of the carpet covering 36 being disposed closely adjacent the floor surface to facilitate acoustic isolation of the space enclosed by the room divider. All joints, panels and carpeting are rigidly glued in place thus forming a rigid truss-like panel which will not flex in any direction.

Figure 13:
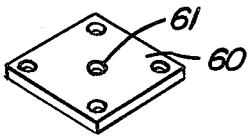
FIG. 13 is a perspective view of an apertured hinge plate.

FIGS. 7 and 8 illustrate the manner of supporting the end edge of the panel 16 from the supporting wall 12, which includes an angle iron bracket 42 having the vertical flange thereof secured to the wall by three lag screws 44, or the like. Projecting laterally from the horizontal flange of the bracket 42 at one end edge thereof is a supporting plate in the form of a strap of rectangular, rigid construction, designated by numeral 46, with the outer end of the strap of plate 46 including a depending pin 48 rigid therewith and extending through a hinge plate 50 having a slot 52 therein and received in a corresponding recess or slot 54 in the top rail 26 with the pin 48 defining a hinge axis and the slot 52 enabling relative inward and outward movement of the top portion of the panel 16 as the panel 16 is pivoted or swung about a generally vertical axis to compensate for floor unevenness or irregularities. The bottom edge of the panel 16 is pivotally supported by a hinge plate 56 anchored to the floor 14 by suitable screw threaded fasteners with the hinge plate including a rigid upstanding pin 58 extending through an aperture 61 in a hinge plate 60 (see FIG. 13) attached to a filler rail 62 along the bottom surface of the bottom rail 28 with a recess 64 being provided to receive the hinge pin 58. Thus, the hinge pin 58 defines a fixed lower end of a vertical axis for swinging movement of the end edge of the panel 16 with the hinge pin 48 and the slot 52 enabling limited inward and outward movement of the upper portion of the panel 16 which may occur due to the supporting casters 38 engaging floor surface areas which are uneven or irregular. Washers 59 forming shims may be used on the pin 58 to more accurately support and position the inner end of panel 16. Thus, the panel 16 may be swung in any angular position about generally a vertical axis defined by the pins 58 and 48 with the slot construction 52 and the recess 54 enabling some inward and outward movement of the upper corner portion of the panel 16 during such swinging movement.

Figure 9:
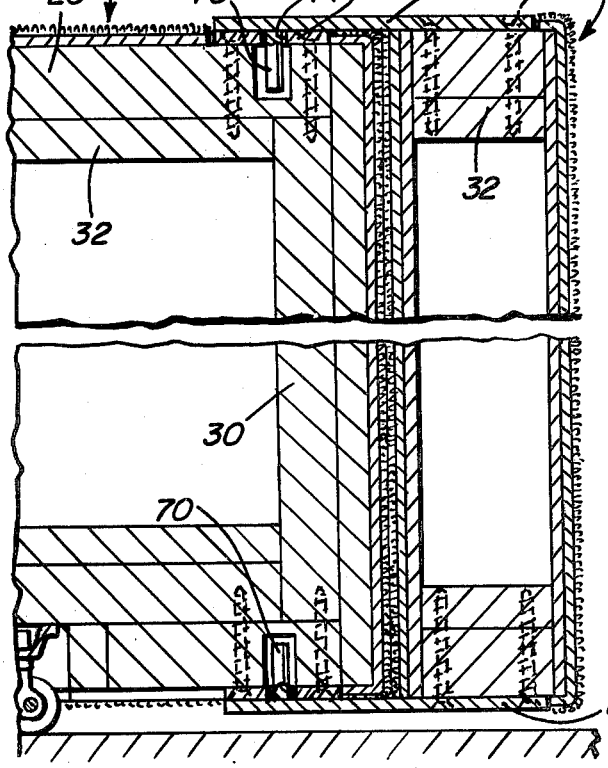
FIG. 9 is a longitudinal, sectional view, taken substantially upon a plane passing along section line 9—9 of FIG. 6 illustrating further structural details of this hinged connection.

FIGS. 6 and 9 disclose the hinge connection between the outer end of the panel 16 and the adjacent end of the panel 18. In this connection, both the top and bottom ends of the panels are provided with an L-shaped plate or bracket 66 having one leg thereof anchored to the top rail 26 of the panel 18 by screw threaded fasteners 68. The perpendicular leg extends into overlying relation to the perpendicularly arranged panel 16 and includes a rigid hinge pin 70 extending laterally therefrom with the upper bracket or plate 66 including a downwardly extending pin 70 and the lower bracket or plate 66 including an upwardly extending hinge pin 70. The top and bottom corners of the panel 16 include a hinge plate 72 secured thereto and including an aperture 74 receiving the hinge pin thus defining a vertical axis for pivotal movement of the panels 16 and 18 in relation to each other with the vertical pivotal axis being disposed at the end of the panel 16 and the end of the panel 18 overlapping the end of the panel 16 when oriented in perpendicular relation as illustrated in FIG. 6 with this vertical hinge axis enabling the panels 16 and 18 to be hinged into parallel side-by-side relation due to the offset of the hinge axis in relation to the longitudinal center line of the panel 18, so that the panels 16 and 18 can assume a stored position, as illustrated in FIG. 2.

FIG. 5 illustrates the hinged construction interconnecting the end of the panel 18 and the end of the panel 20 which includes a pair of plates 76 of identical construction secured to the top rail of the respective panels 18 and 20 with each of the plates 76 including an offset or angularly extending lug or ear 78 disposed in overlying relation and interconnected by a hinge pin, rivet, bolt, or other similar fastener 80 to enable the panel 20 to be pivoted from a position in alignment with the panel 18 to a position alongside of and parallel to the panel 18 and any position inbetween these two extremes.

Figure 10:
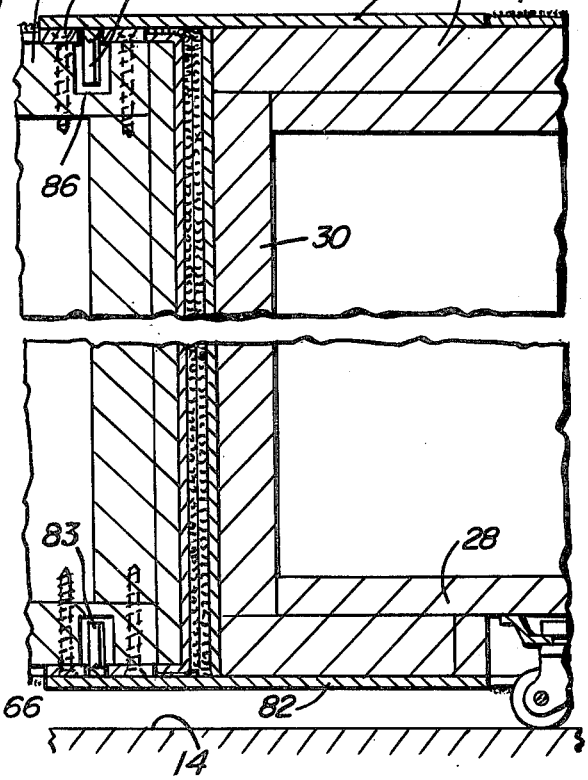
FIG. 10 is a longitudinal, vertical sectional view, taken substantially upon a plane passing along section line 10—10 of FIG. 9 illustrating further structural details of this hinged connection.

FIGS. 4 and 10 illustrate the hinge connection between the access door 22 and the remainder of the panel 20 which includes a pair of identical plates 82, one of which is mounted on the top edge of the panel 20 and one of which is mounted on the lower end of the panel 20 and which project beyond the vertical end edge of the panel 20 and terminate in an inwardly extending pin 83 rigid therewith, with the pins 83 being centrally disposed in relation to the side edges of the plate 82 and spaced inwardly from the end edge thereof and received through an aperture in a hinge plate 84 at the top and bottom edges of the panel respectively, with the pins 83 being received in a recess 86 thus defining a vertical axis for pivotal movement of the access door.

With the structure as disclosed, the room divider 10 may be oriented in various positions including the position illustrated in FIG. 1, which may be termed an operative position and a stored or collapsed position illustrated in FIG. 2. Various panel assemblies may be employed, including a single panel or a pair of panels, three panels as illustrated or any desired number of panels to enclose a desired space or to cooperate with other similar room dividers which may be attached to the same or an adjacent permanent wall in order to divide the space into a plurality of predetermined areas for use as separate class rooms, conference rooms, and the like. The double roller caster support enables anyone including a student, teacher, or the like to quickly and easily orient the room divider in a desired position and to enable the room divider to be moved to a stored position when desired. The specific structure enables easy installation in existing building structures even if the floor surface has some degree of unevenness or irregularity in view of the slot construction at the upper corner of the panel attached to the wall. The carpet cover enables pictures or other items to be easily mounted and displayed thereon including chalk boards, or the like, or a permanently mounted chalk board may be provided on any of the panels, if desired. The carpet cover also serves as a sound attenuating material, thus tending to acoustically isolate the enclosed space. The vertical height of the panels may vary depending upon the requirements in each individual installation and the use of a swinging access door is optional and, if desired, any type of spring return mechanism may be provided on the access door to return it to closed position. The use of the access door provides effective entrance and egress for the enclosed space and enables more complete acoustic and visual isolation of the enclosed space. As illustrated, the end edges of panel 16 and one edge of the door 22 are tapered, beveled or rounded to provide a seal with adjacent surfaces and the pivot axis 80 is generally aligned with the corners of the panels 18 and 20. When only two panels are used, such as by using panel 20 connected to panel 16 by bracket plates 66, the panel 20 can fold inwardly and be disposed between panel 16 and the wall 12 due to the offset of hinge pins 48 and 56.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A room divider comprising a plurality of vertically disposed, rigid panels, means pivotally connecting adjacent end edges of adjacent panels together, means pivotally supporting only the free end edge portion of one of the endmost of said panels from a building structure to enable swinging movement about a substantially vertical axis, means along the lower edge of said panels for rolling engagement with a supporting floor surface, the end of the other endmost panel remote from the point of attachment with the building structure including a pivotal access door, and means pivotally connecting the access door to the adjacent panel, said means connecting the end edge portion of one panel to a building structure including a supporting plate rigidly connected to the building structure adjacent a vertical support and including an upstanding pivot pin pivotally engaging the bottom edge of the end portion of the panel, a bracket attached to the vertical support in vertically spaced relation to the mounting bracket and including a depending pivot pin engaging a longitudinal slot in a plate in the top edge of the end portion of the panel to enable inward and outward movement of the top edge portion of the panel connected to the building structure to compensate for unevenness and irregularity in the floor surface supporting the panels.

2. The structure as defined in claim 1 wherein said means pivotally connecting adjacent edges of the panels includes an L-shaped bracket attached to the top and bottom edges of one panel respectively and the laterally extending leg of the L-shaped bracket including an inwardly extending pin pivotally received in a hinge plate on the top and bottom edges of the other panel respectively to provide an offset vertical hinge axis to enable the panels to be oriented in various angular relations to each other including parallel side-by-side relation.

3. The structure as defined in claim 1 wherein said means pivotally connecting adjacent edges of the panels including top and bottom brackets on the end edge of each panel with each bracket including a laterally inclined lug at the end edge thereof with the lugs disposed in overlapping relation, and a pivot pin extending through the lugs defining an offset vertical hinge axis between the adjacent panels to enable the panels to be disposed in longitudinal alignment with each other or in folded side-by-side relation and any angle therebetween.

4. The structure as defined in claim 1 wherein said means pivotally connecting the access door to the adjacent panel includes a pair of plates attached to the top and bottom edges respectively of the adjacent panel and projecting longitudinally therefrom and terminating in inwardly extending pivot pins extending through apertured pivot plates on the top and bottom edges of the access door to define a vertical hinge axis for the access door.

5. The structure as defined in claim 4 wherein each of said panels is constructed with an interior frame and a covering of carpet material for sound attenuation for acoustically isolating an enclosed space.

6. The structure as defined in claim 5 wherein said means supporting the bottom edges of the panels includes a pair of caster assemblies on each of the panels disposed adjacent the end edges thereof, each caster assembly including a double roller caster for rollingly supporting the panel from a floor surface to enable the panels to be easily moved from one position to another.

7. The structure as defined in claim 6 wherein said interior frame includes cover panels thereon, said cover panels, frame and carpet being rigidly bonded together to form a rigid panel.

8. The structure as defined in claim 7 wherein said panels include certain rounded end edges to form a seal with respect to the building structure and with respect to each other.

9. In combination with a building structure having a large space defined in part by a floor and a vertical wall fixed in relation to the floor, a space divider comprising at least three rigid panels disposed in end to end relation, means pivotally supporting one end portion of one endmost panel from the building structure for pivotal movement about a substantially vertical axis, means pivotally connecting the other end portion of said one endmost panel to the end portion of an adjacent intermediate panel, means pivotally connecting one end portion of the other endmost panel to the end portion of an adjacent intermediate panel, the other end portion of said other endmost panel being free to move in relation to the building structure, roller means on the bottom edge of each panel to support the panels movably on the surface of the floor, said means supporting one end portion of said one endmost panel including a wall mounted bracket projecting horizontally outwardly from the vertical wall into overlying relation to the top edge of said one endmost panel, a floor mounted plate having a rigid upstanding pin, a hinge plate on the bottom edge of said one endmost panel receiving said hinge pin, and a pin and slot connection between the wall mounted bracket and the top edge of said one endmost panel to enable unrestricted, free movement of the top edge portion of said one endmost panel inwardly and outwardly in relation to the wall within the dimensional limits of the slot during swinging movement of the panels with the roller means in supporting engagement with an uneven floor.

* * * * *